United States Patent [19]

Liu

[11] Patent Number: 5,027,629

[45] Date of Patent: Jul. 2, 1991

[54] CONTROL MECHANISM OF ELECTRONIC LOCK

[76] Inventor: Yin-Chic Liu, P.O. Box 10160, Taipei, Taiwan

[21] Appl. No.: 468,058

[22] Filed: Jan. 22, 1990

[51] Int. Cl.[5] ..... E05B 47/00

[52] U.S. Cl. ..... 70/277; 70/279; 70/280; 70/224; 70/107

[58] Field of Search ..... 70/277–279, 70/276, 280–282, 107, 224, 413

[56] References Cited

U.S. PATENT DOCUMENTS

| | | | |
|---|---|---|---|
| 3,212,305 | 10/1965 | Russell et al. | 70/224 |
| 3,894,417 | 7/1975 | Taniyama | 70/277 X |
| 3,926,021 | 12/1975 | Genest et al. | 70/280 X |
| 4,148,092 | 4/1979 | Martin | 70/278 X |
| 4,183,563 | 1/1980 | Stevens | 70/107 X |
| 4,457,148 | 7/1984 | Johansson et al. | 70/278 |
| 4,656,850 | 4/1987 | Tabata | 70/282 X |
| 4,672,826 | 6/1987 | Mombelli | 70/278 |
| 4,784,415 | 11/1988 | Malaval | 70/282 X |
| 4,802,353 | 2/1989 | Corder et al. | 70/278 X |
| 4,820,330 | 4/1989 | Lin | 70/278 X |
| 4,843,851 | 7/1989 | Frolov | 70/279 X |
| 4,899,562 | 2/1990 | Gartner et al. | 70/277 |
| 4,956,984 | 9/1990 | Chi-Cheng | 70/279 X |

*Primary Examiner*—Robert L. Wolfe
*Assistant Examiner*—Suzanne L. Dino

[57] ABSTRACT

An electronic lock includes two covers respectively formed on an outside and inside of a door, a tumbler slidably moving in a tumbler hole formed in a central transmission shaft secured to an outside door knob and moving in a tumbler socket formed in a sleeve engageable with the central shaft and secured to an inside knob, in which the tumbler is operated, by the action of a magnet manually swung or by an electromagnetic coil which is powered by a sensor when sensing a correct coded number card inserted in the sensor, to couple the central transmission shaft with the sleeve coupled to a dead latch so that upon a rotation of the outside knob to rotate the central shaft, the sleeve will be rotated to retract the dead latch for opening the door.

10 Claims, 5 Drawing Sheets

CONTROL MECHANISM OF ELECTRONIC LOCK

BACKGROUND OF THE INVENTION

U.S. Pat. No. 4,820,330 invented by Jui-Chang Lin discloses a structure for controlling the dead bolt used in an electronic lock which however has the following drawbacks:

1. When the cross rod 441 is to be retreated to the outside of rail 49, the upper round part of the cross rod 441 is moved from the engaged notch 493 of the rail 49 to the inclined way 494 to compress the springs 492 of the rail 49 as urged by the spring 43 jacketed on the moving base 44, thereby easily causing an elastic fatigue of the spring 43 after a long time operation of the lock.

Since the cross rod 441 should be operatively engaged with the grooves 452 of engaging disc 45 and the grooves 463 of the engaging base 46 for opening the lock from the outside knob 11, each groove 452 or 463 is preferably made as an outwardly enlarged arcuate shape for smoothly engaging the cross rod 441. However, such an arcuate groove (port) may not carry the upper round part of the cross rod 441 to sharply match the notch 493 of rail 49 when opening the lock. Once an elastic fatigue is caused to the spring 43, the upper round part of the cross rod 441 even urged by the spring 43 may be frictionally retarded on the rail surface 49 and can not be poked into the notch 493 to engage the grooves 452 of disc 45, unable for opening the lock.

2. So many elements of the base plate 3 and moving parts 4 are provided to increase production cost and maintenance problems of a complete lock. The so many elements of the lock may also increase their production complexity. Also, many elements in construction of the lock may not be operated very smoothly as expected. For instance, the cross rod may not be precisely operated in cooperation with the rail to cause malfunction or false action. So many springs may also be counteracted with each other to easily cause fatigue failure to possibly lose their nomal effects, thereby causing the maintenance problems.

The present inventor has found the drawbacks of a conventional electronic lock, and invented the present control mechanism of electronic lock.

SUMMARY OF THE INVENTION

The object of the present invention is to provide a control mechanism of an electronic lock including an outside cover, an inside cover, a base, a control means and a dead latch in which a set of pin tumblers is electromagnetically operated for engaging a shaft of an outside or inside knob with the dead latch so as for opening the lock with simpler construction and minor maintenance problems.

DETAILED DESCRIPTION

Figure 1:
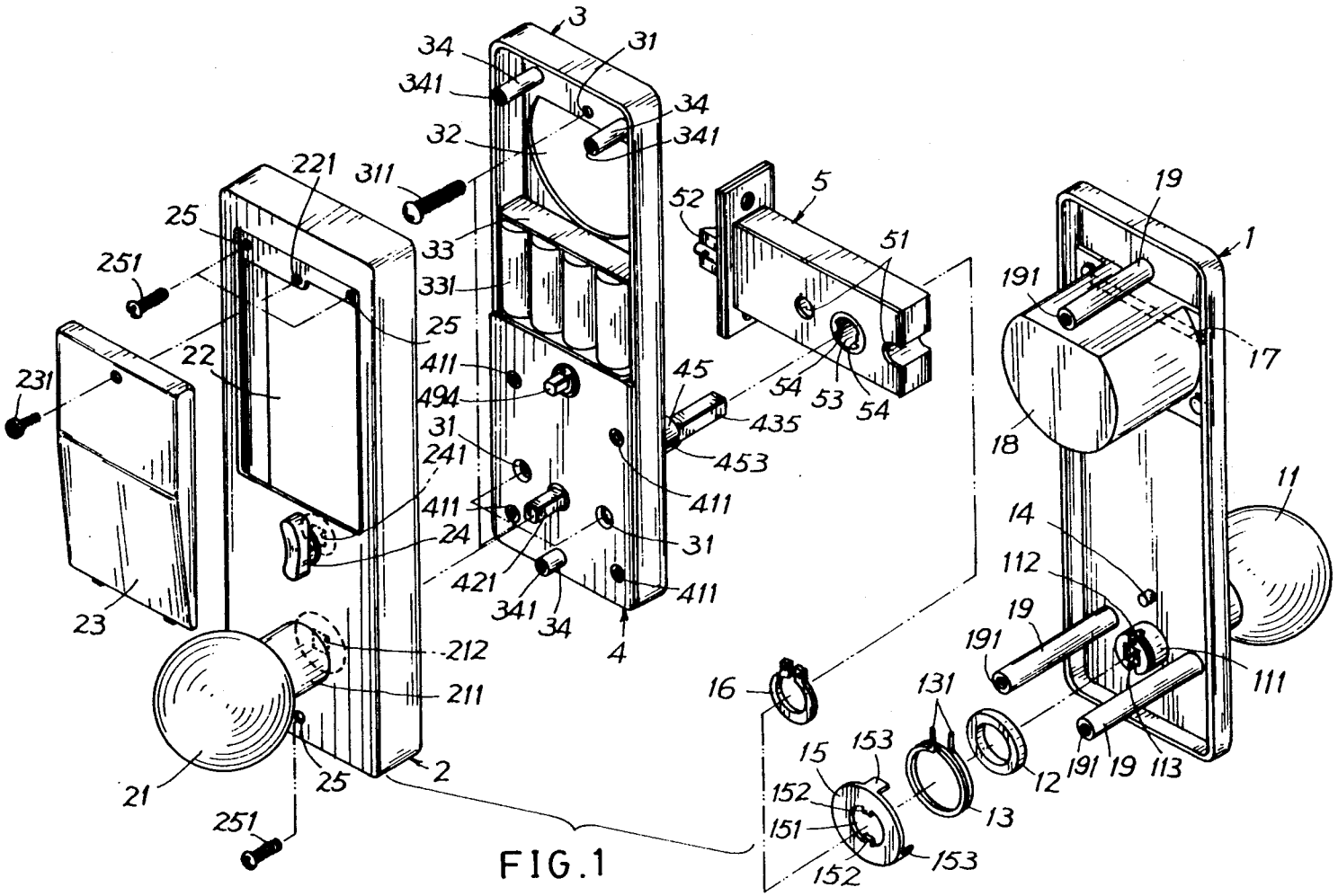
FIG. 1 is an exploded view of the present invention.

As shown in the figures, the present invention comprises: an outside cover 1, an inside cover 2, a base 3, a control means 4 and a dead latch means 5.

Figure 5:
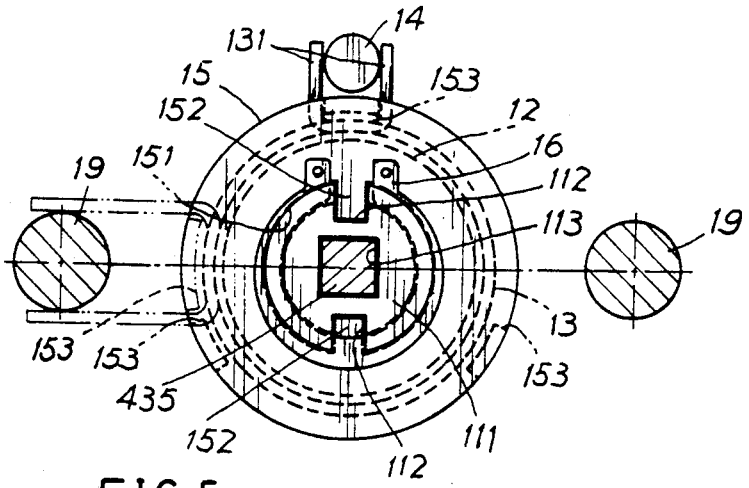
FIG. 5 is a sectional drawing of the present invention when viewed from direction A—A of FIG. 3.

As shown in FIG. 1, an outside knob 11 includes a rotating shaft 111 pivotably mounted in the outside cover 1. A washer 12 and restoring spring 13 are jacketed on the shaft 111 inside the cover 1. Two spring ends of the spring 13 are crosswise separated by a protrusion 14 formed on a central inside wall of the cover 1 above the shaft 111. A restoring retainer 15 includes a central hole 151 having two lugs 152 radially protruding from the hole 151 to be engaged with two notches 112 formed in an inner portion of the shaft 111, a plurality of pawls 153 longitudinally formed on a perimeter of the retainer 15 for defining the spring 13 and washer 12 therein, of which a pawl 153 is inserted between the two spring ends 131 of the spring 13 so as to maintain a specific orientation of the knob 11 rotatably mounted in the cover 1. The pawls 153 may also be obstructed by the spring ends 131 when the retainer 15 is rotated to prevent a wide-range rotation of the knob 11. A square hole 113 is formed in an inner end portion of the shaft 111. A sensor 18 is fixed inside the cover 1 for checking and reading a coded number card C insertable in a slot 17 formed in an outside cover 1. A plurality of stems 19 are formed inside the cover 1 for connecting the base 3. As shown in dotted line of FIG. 5, the spring ends 131 may also be held on one stem 19 formed on the cover 1.

The inside cover 2 includes an inside knob 21 having a rotating shaft 211 rotatably mounted in the inside cover 2 projectively aligned to the outside knob 11, a window 22 formed in the cover 2, a window shield 23 covering the window 22 and fixed on the cover 2 by a screw 231 engaged with a screw hole 221 formed in the cover 2, and a thumbturn 24 rotatably secured on the cover 2. A square hole 212 is formed in an inner end portion of the shaft 211, whereas another square hole 241 is formed inside the thumbturn 24.

Figure 3:
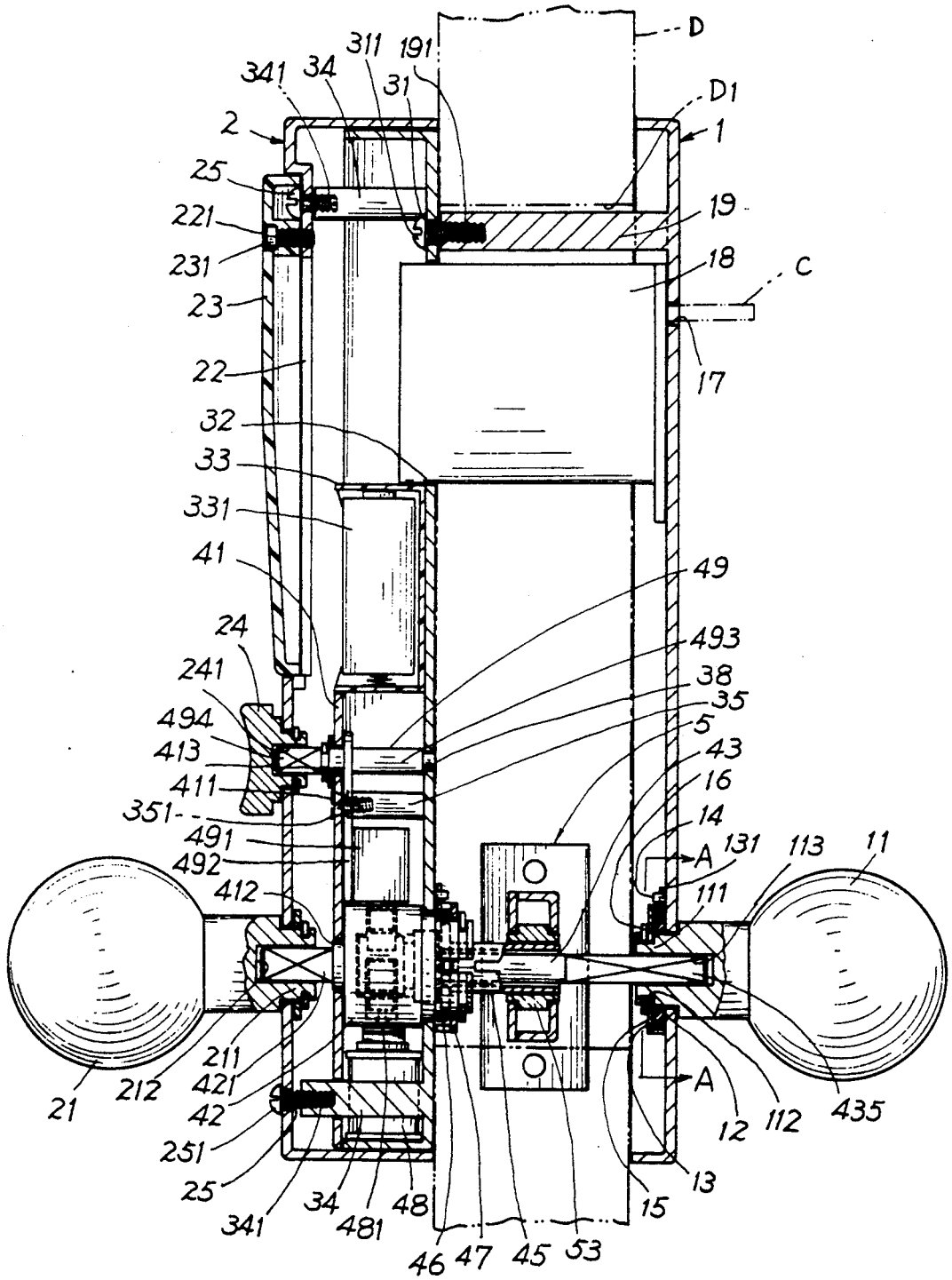
FIG. 3 is a sectional drawing of the present invention as assembled.

The base 3 includes a plurality of stem holes 31 each for inserting a screw 311 therethrough for securing the base 3 to the outer cover 1 (screw 311 engageable with the screw hole 191 formed in each stem 19) as spaced by a door D as shown in FIG. 3, a sensor hole 32 for storing the sensor 18 fixed on the cover 1, a battery socket 33 formed in the base 3 for storing a plurality of dry batteries 311 therein for powering the sensor 18, and a plurality of stems 34 protruding towards the inside cover 2 for inserting a plurality of screws 251 through screw holes 25 formed in cover 2 and engaging holes 341 formed in the stems 34 for securing the base 3 to the cover 2 for shielding the base 3 within a door D by the cover 2.

Figure 2:
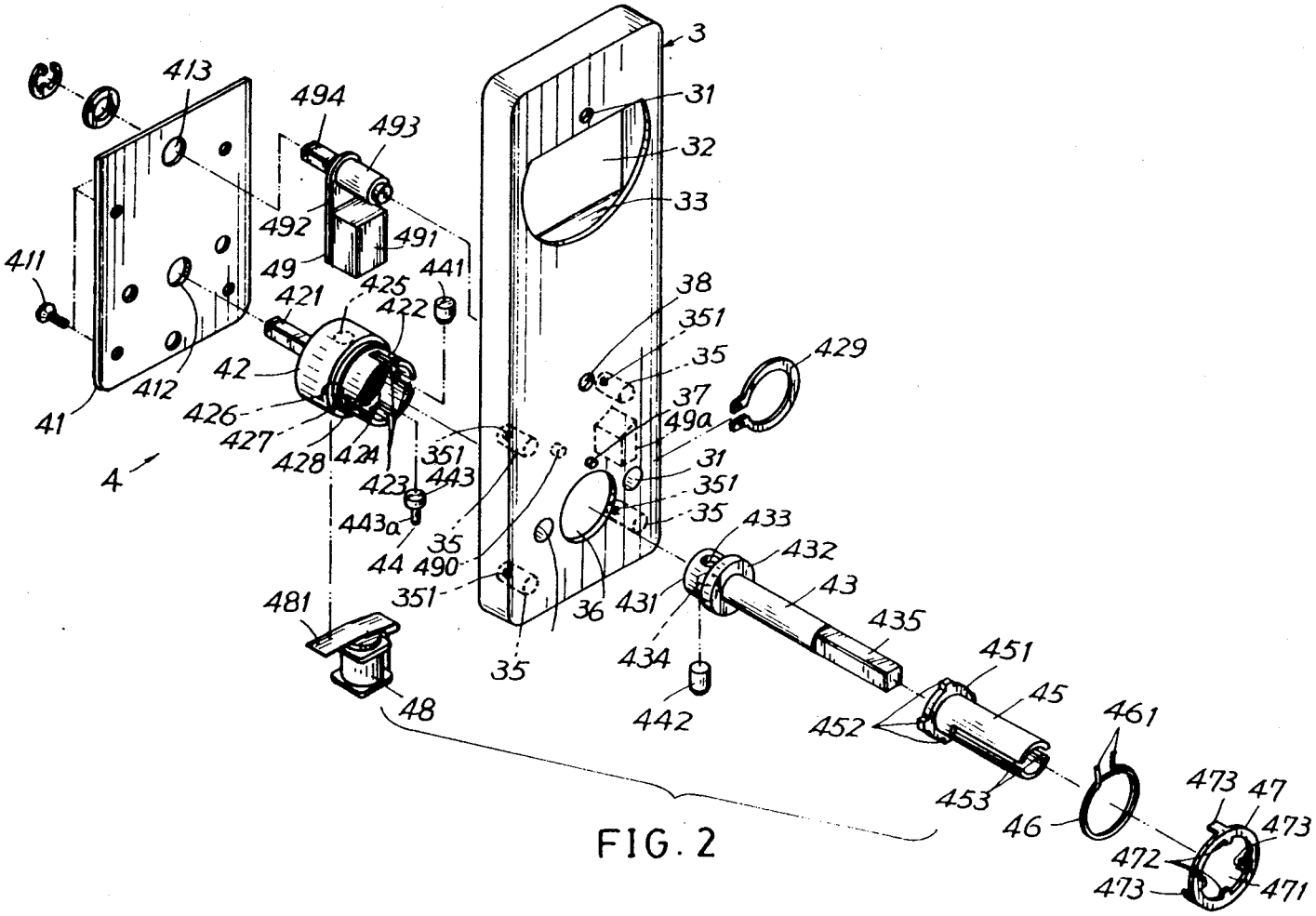
FIG. 2 is an exploded view showing partial elements of the present invention.
Figure 4:
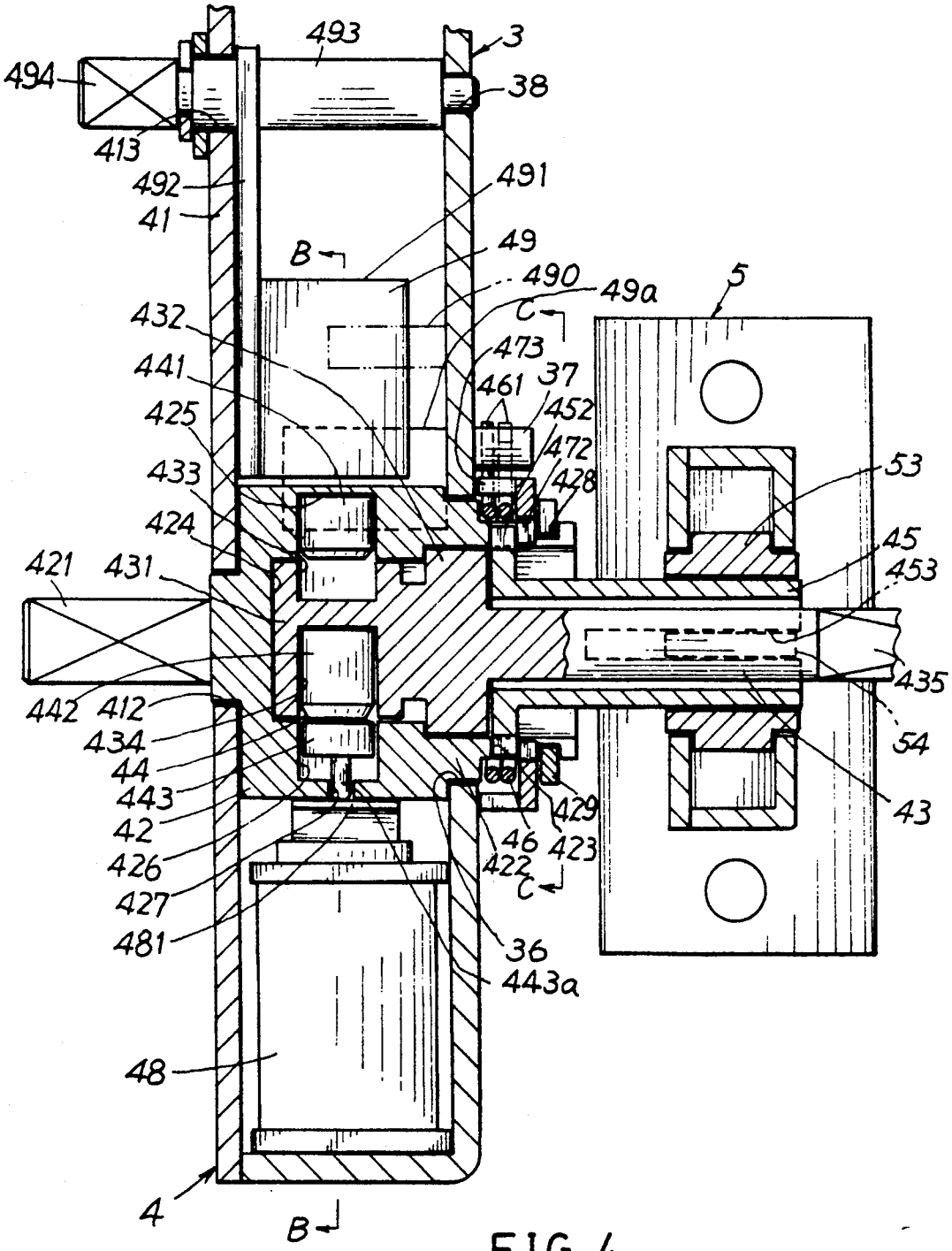
FIG. 4 is a detailed sectional illustration of the present invention when assembled.

As shown in FIGS. 2, 3, and 4, the control means 4 includes: a covering plate 41 secured on a plurality of stems 35 of the base 3 by fixing screws 411 in the holes 351 of stems 35, a first sleeve 42 secured to the inside knob 21, a central transmission shaft 43 secured to the outside knob 11 and operatively engageable with the sleeve 42, a tumbler set 44 operatively coupling the shaft 43 with the first sleeve 42, a second sleeve 45 jacketed on the transmission shaft 43, a restoring spring 46, a restoring retainer 47, an electromagnetic coil 48 formed under the first sleeve 42, a magnetic actuator 49 formed above the first sleeve 42, and a magnet positioner 49*a*.

The first sleeve 42 includes a square shaft 421 protruding towards the inside knob 21 to engage the square hole 212 of the knob 21, and a transmission cylinder 422 protruding towards the outside cover 1 having a plurality of notches 423 formed in the cylinder 422 for connecting the second sleeve 45. A cylindrical recess 424 is longitudinally recessed in the cylinder 422 for rotatably engaging a cylindrical head 431 of the central transmission shaft 43. An upper tumbler socket 425 is vertically radially recessed in an upper portion of the cylindrical recess 424 of the sleeve 42 for movably storing an upper tumbler 441 of the tumbler set 44 therein, whereas a lower tumbler socket 426 is vertically radially recessed in a lower portion of the cylindrical recess 424 for movably storing a lower tumbler 442 of the tumbler set 44 and slidably storing a lowest tumbler 443 supporting the lower tumbler 442 overlain on the lowest tumbler 443. A pin hole 427 is formed in a bottom portion of the sleeve 42 to communicate the lower tumbler socket 426 for reciprocating a pin 443*a* formed on a bottom portion of the lowest tumbler 443. The first sleeve 42 is rotatably held and defined between the covering plate 41 and the hole 36 formed in the base 3 as shown in FIG. 4.

The central transmission shaft 43 includes a cylindrical head 431 and a flange 432 formed on an inner end of the shaft 43 rotatably engageable in the recess 424 of the sleeve 42 and a square shaft portion 435 formed on an outer end of the shaft 43 engaged with the square hole 113 of the outside knob 11. An upper tumbler hole 433 is formed in an upper portion of the cylindrical head 431 of the shaft 43 correspondingly facing the upper tumbler socket 425 of the sleeve 42 for reciprocating the upper tumbler 441 in the hole 433. A lower tumbler hole 434 is formed in a lower portion of the cylindrical head 431 correspondingly facing the lower tumbler socket 426 of the sleeve 42 for reciprocating the tumbler 442 therein. The upper hole 433 is vertically projectively aligned with the lower hole 434, whereas the upper socket 425 is projectively vertically aligned with the lower socket 426. The tumbler set 44 includes the upper tumbler 441 which is made of magnetically attractive materials such as ferrous material, the lower tumbler 442 and the lowest tumbler 443 having a pin 443*a* formed thereunder and having a longitudinal section of T shape. The lower tumbler 442 and the lowest tumbler 443 may be made of materials not magnetically attractive. The restoring spring 13 and retainer 15 may normally restrict the shaft 43 to ensure an upward orientation of the upper hole 433 and a downward orientation of the lower hole 434 since one pawl 153 of the retainer 15 is limited between two spring ends 131 of the restoring spring 13. The spring 13 and retainer 15 may also prevent a false positioning of the tumbler sockets and holes, for example, for preventing the matching of the upper socket 425 with the lower hole 434 or preventing the matching of the upper hole 433 with the lower socket 426.

The second sleeve 45 includes a flange 451 formed on its inner end having a plurality of lugs 452 formed on a perimeter of the flange 451 engageable with the notches 423 formed in cylinder 422 of first sleeve 42, and two longitudinal slits 453 symmetrically formed in two side walls of the sleeve 45.

The restoring spring 46 is jacketed on the transmission cylinder 422 having two spring ends 461 crosswise separated by a protrusion 37 formed on a central portion of the base 3 above the hole 36. The restoring retainer 47 includes a central hole 471 disposed around the transmission cylinder 422, two lugs 472 protruding radially from the hole 471 to engage the notches 423 in the cylinder 422, and a plurality of pawls 473 longitudinally formed on a perimeter of the retainer 47 for defining the spring 46 therein having one pawl 473 inserted in between the two spring ends 461 of the spring 46 proximate to the protrusion 37 to ensure the positioning of the upper tumbler socket 425 of the cylinder 422 to be above and matching with the upper hole 433 of the shaft 43 and positioning the lower socket 426 to be under and matching with the lower hole 434 of the shaft 43. The outer end portion of the transmission cylinder 422 of the first sleeve 42 is formed with an annular groove 428 on which a retainer ring 429 is engaged for limiting the elements jacketed on the cylinder 422.

An electromagnetic coil 48 is fixed on the base 3 under the first sleeve 42, which coil 48 is controlled by the sensor 18. A spring plate 481 is formed on the coil 48 normally urging the lowest tumbler 443 and lower tumbler 442 to form an interface between the tumblers 442, 443 matching with an interface between the cylindrical head 431 and the cylindrical recess 424 for a free rotation of the shaft 43 in the sleeve 42.

The magnetic actuator 49 includes: a magnet 491 formed on a lower portion of a linking plate 492, an axle 493 transversely secured to the linking plate 492 and pivotally mounted in a hole 38 of the base 3 above the sleeve 42, a square shaft 494 protruding from the axle 493 and through the covering plate 41 to be fixed into the square hole 241 of the thumbturn 24 so that the thumbturn 24 may be turned to drive the magnet 491 to be proximately positioned above the socket 425 or separated from the socket 425 of the sleeve 42. The sleeve 42 and shaft 43 are made of materials not electromgnetic attractive.

The dead latch means 5 includes two stem holes 51 for passing two stems 19 of the outside cover 1 through the holes 51 for fixing the dead latch means 5 in a door D as shown in FIGS. 1 and 3, a latch 52 normally protruding sidewardly to be locked on a door frame (not shown), and a collar 53 having two lugs 54 formed inside a collar ring to engage the two longitudinal slits 453 formed in the second sleeve 45. The collar 53 may be rotated by the sleeve 45 to extend or retract the latch 52 for closing or opening the door D.

When assembling the electronic lock of the present invention, the outside cover 1 is formed outside the door D whereas the sensor 18 and stems 19 are formed in a door opening D1. The dead latch means 5 is fixed on the stems 19 of the cover 1. The second sleeve 45 is coupled to the dead latch means 5 and coupled to the first sleeve 42. The base 3, the inside cover 2 and the control means 4 are all formed inside the door D. The details for fixing the relevant elements of the present invention have been described as aforementioned.

Figure 6:
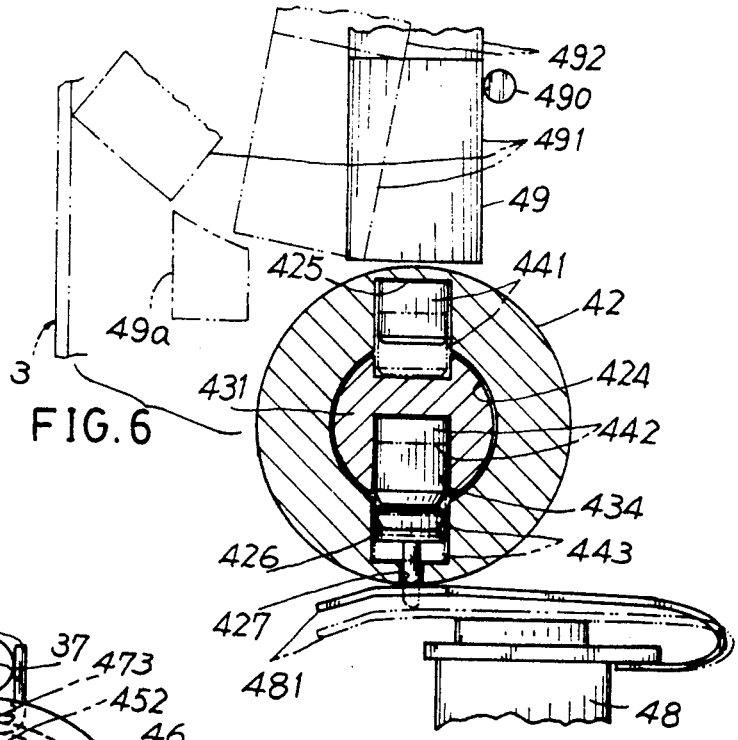
FIG. 6 is a sectional drawing of the present invention when viewed from direction B—B of FIG. 4.
Figure 7:
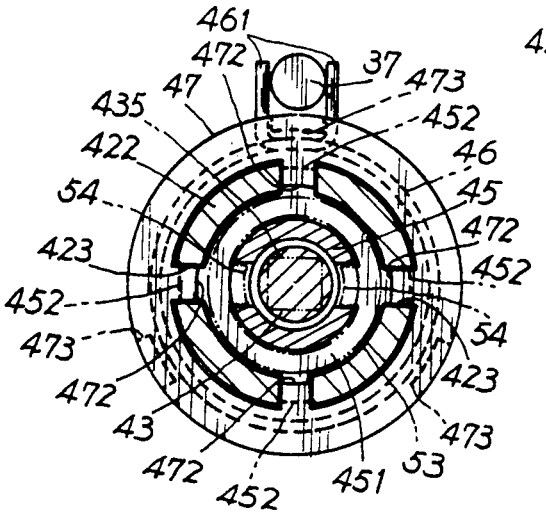
FIG. 7 is a sectional drawing of the present invention when viewed from direction C—C of FIG. 4.

By turning the thumbturn 24 to move the magnet 491 of the magnetic actuator 49 towards the first sleeve 42 as shown in FIGS. 4 and 6 (solid line), the upper tumbler 441 is attracted to to be positioned above the interface between the recess 424 and the cylindrical head 431. The spring plate 481 above the electromagnetic coil 48 normally urges the tumbler 443 in the lower socket 426 which in turn urges the tumbler 442 to be positioned above the interface between the recess 244 and the cylindrical head 431 so that when rotating the knob 11 outside the door the shaft 43 is freely rotated without driving the first sleeve 42, thereby locking the latch 52 and the door D.

When opening the lock and the door, a coded number card D can be inserted into the slot 17 from an outside of the door to be read by the sensor 18 for switching on an electric current from the power source of dry batteries 331 for powering the electromagnetic coil 48 of which the powered coil 48 will attract the spring plate 481 downwardly without supporting the tumbler 443 and the tumbler 442 will gravitationally drop to intersect the interface between the recess 424 of the sleeve 42 and the cylindrical head 431 of shaft 43 for coupling the shaft 43 with sleeve 42, whereby upon a rotation of the outside knob 11, the shaft 43 and the coupled sleeves 42, 45 will be rotated to retract the latch 52 for opening the door. The pendant magnet 491 may be limited or stopped by a protrusion 490 as shown in FIG. 6. Naturally, a person inside the door may also turn the thumbturn 24 to leave the magnet 491 from the vertical pendent state as shown in dotted line of FIG. 6, whereby upon the gravitational dropping of the tumbler 441, the cylindrical head 431 of the shaft 43 will be coupled to the sleeve 42 which is already coupled to the sleeve 45 and latch 52 so that the inside knob 21 can be rotated to rotate the shaft 43 so as to retract the latch 52 for opening the door. When the magnet 491 is swung sidewardly as shown in dotted line of FIG. 6, another magnet 49*a* of the magnet positioner having a magnetic pole as same as the pole of the magnet 491 may be provided on a side wall of the base 3 to repel the magnet 491 towards the side wall of the base 3 for temporarily removing the magnetic actuator 49 without attracting the tumbler 441 for ensuring a normal opening of the door D.

The present invention has the following advantages superior the conventional electronic lock especially as disclosed in U.S. Pat. No. 4,820,330:

1. The control means 4 is simply operated by a magnetic or electromagnetic force for a more precise coupling of the central shaft 43 with the sleeves 42, 45 or uncoupling of them to prevent malfunction or false operation of the lock.

2. Many elements easily causing malfunction as disclosed in the prior art have been eliminated and the structure or construction of the lock has been simplified for optimizing the production steps, for reducing production cost and minimizing maintenance problems.

3. The tumblers 442, 443 are always gravitationally supported on the spring plate 481 of the electro-magnetic coil 48. The energy required to electromagnetically attract the spring plate 481 downwardly by the coil 48 will be reduced since the downwardly acting gravitational force of the tumblers 442, 443 will facilitate the downward movement of the spring plate 481 (as shown in dottd line of FIG. 6), thereby saving the electric energy of batteries and prolonging the duration for using the card C for opening the lock.

I claim:

1. A control mechanism of electronic lock comprising:

an outside cover fixed on an outside surface of a door having an outside knob rotatably mounted in said outside cover and a sensor fixed on an inside surface of the outside cover operatively reading a coded number card inserted through a slot formed in said outside cover;

an inside cover projectively aligned to said outside cover fixed on an inside surface of the door having an inside knob rotatably mounted in said inside cover;

a base secured between said outside cover and said inside cover and fixed on an inside surface of the door having a battery socket for storing batteries therein for powering said sensor;

a control means including a first sleeve rotatably mounted in said base having an inner end portion of said first sleeve secured to said inside knob and having an outer end portion of said first sleeve normally coupled with a second sleeve, a central transmission shaft having an inner end portion of said transmission shaft rotatably held in said first sleeve and having an outer end portion of said transmission shaft secured to said outside knob, a tumbler set operatively coupling said first sleeve and said central transmission shaft, an electromagnetic coil fixed on said base under said first sleeve for coupling said first sleeve and said central transmission shaft when powered by said batteries as sensed by said sensor, and a magnetic actuator having a magnet and pivotally secured on said base having a thumbturn connected with said magnetic actuator pivotally mounted on said inside cover for operatively coupling said first sleeve with said central transmission shaft;

a dead latch means having a latch normally extending sidewardly for closing the door and a collar engaged with said second sleeve of said control means, said collar operatively retracting said latch for opening the door when rotating said first sleeve and said second sleeve;

said first sleeve rotatably mounted in between a base and a covering plate secured to said base including a square shaft formed on an inner end of said first sleeve fixed to the inside knob, a transmission cylinder formed on an outer end of said first sleeve having a plurality of notches formed in said cylinder, a cylindrical recess recessed in said transmission cylinder, an upper tumbler socket radially vertically formed in an upper portion in said cylindrical recess, and a lower tumbler socket radially vertically formed in a lower portion of said cylindrical recess under said upper tumbler socket, a pin hole formed in a bottom portion of said first sleeve communicated with said lower tumbler socket;

the improvement which comprises:

said central transmission shaft including a cylindrical head formed on an inner end of said transmission shaft rotatably engageable in said cylindrical recess of said first sleeve having an upper tumbler hole formed in an upper portion of said cylindrical head operatively matching with said upper tumbler socket of said first sleeve and a lower tumbler hole formed in a lower portion of said cylindrical head operatively matching with said lower tumbler socket of said first sleeve, and a square shaft portion formed on an outer end of said transmission shaft to be secured to said outside knob, whereby upon a sensing of said sensor by a correct coded number card, said electromagnetic coil is powered for actuating said tumbler set for coupling said first sleeve and said central transmission shaft so that said outside knob can be rotated to rotate said central transmission shaft, said first and second sleeves to retract said latch of said dead latch means for opening the door, or upon a swinging of said magnetic actuator to approach said tumbler set allowing said tumbler set to couple said first sleeve and said central transmission shaft, the outside knob can be rotated for opening the door.

2. A control mechanism of electronic lock according to claim 1, wherein a lower tumbler of said tumbler set is movably stored in said lower tumbler hole of said central transmission shaft, said lower tumbler being supported by a lowest tumbler movably stored in said lower tumbler socket in said first sleeve, said lowest tumbler having a pin formed on a lower portion of said lowest tumbler movably held in said pin hole in said first sleeve forming a cross section of T shape of said lowest tumbler, said pin normally urged by a spring plate formed on said electromagnetic coil to allow said lowest tumbler to support said lower tumbler for forming an interface between said lower tumbler and said lowest tumbler to match with an interface between said cylindrical recess of said first sleeve and said cylindrical head of said central transmission shaft, whereby upon the sensing of said sensor for powering said electromagnetic coil, said spring plate will be attracted downwardly to gravitationally drop said lower tumbler and said lowest tumbler to intersect the interface between the cylindrical head of said transmission shaft and said cylindrical recess of said first sleeve for coupling said central transmission shaft with said first sleeve so that when rotating the outside knob to rotate the central transmission shaft, said first and second sleeves will be rotated to retract said latch of said dead latch means for opening the door.

3. A control mechanism of electronic lock according to claim 1, wherein an upper tumbler of said tumbler set is gravitationally dropped in said upper tumbler hole in said cylindrical head of said transmission shaft to intersect the interface between said cylindrical head and said first sleeve for coupling the central transmission shaft with the first sleeve, so that said outside knob can be rotated for opening the door.

4. A control mechanism of electronic lock according to claim 3, wherein said upper tumbler is made of magnetically attractive material and is attracted upwardly into said upper tumbler socket to be positioned above the interface between said first sleeve and said transmission shaft by said magnet of said magnetic actuator, allowing a free rotation of said central transmission shaft with respect to said first sleeve.

5. A control mechanism of electronic lock according to claim 1, wherein a second magnet of a magnet positioner having a magnetic pole as same as a pole of said magnet of said magnet actuator is provided on a side wall of the base for repelling said magnet of said magnet actuator towards a side wall of said base when the magnet actuator is swung to leave from the upper tumbler, a protrusion provided on a central portion above the upper tumbler socket to limitedly stop said magnet of said magnetic actuator when the magnet of said magnet actuator is repelled towards a central position by the second magnet.

6. A control mechanism of electronic lock according to claim 1, wherein a restoring means is provided for normally orienting said central transmission shaft and said first sleeve in a specific direction to prevent a false matching of the upper tumbler hole with a lower tumbler socket formed in a lower portion of said first sleeve.

7. A control mechanism of electronic lock according to claim 1, wherein said dead latch means includes said collar jacketed on said second sleeve having two lugs formed on a collar ring respectively engaged with two longitudinal slits formed in two opposite side walls of said second sleeve so that upon a rotation of said second sleeve, said collar will be rotated to retract said latch for opening the door.

8. A control mechanism of electronic lock according to claim 1, wherein said second sleeve includes a plurality of lugs formed on a flange on an inner end of said second sleeve to be engaged with a plurality of notches formed in a transmission cylinder of said first sleeve.

9. A control mechanism of electronic lock according to claim 6, wherein said restoring means includes a restoring spring jacketed on an inside shaft portion of said outside knob having two spring ends of said restoring spring crosswise separated by a protrusion formed on a central inside wall of the inside cover and a restoring retainer secured on the inside shaft portion of said outside knob having pawls longitudinally formed on the retainer defining the restoring spring within the pawls and having one pawl inserted between two spring ends of said restoring spring to ensure a specific orientation of said outside knob and the transmission shaft secured to said outside knob, and having the other pawls limited by any one said spring end to prevent a wide range rotation of said outside knob.

10. A control mechanism of electronic lock according to claim 6, wherein said restoring means includes a second restoring spring jacketed on the transmission cylinder of said first sleeve having two spring ends of said second restoring spring crossingly separated by a second protrusion formed on a central portion of said base above said first sleeve, and a second restoring retainer secured on an outer end of said transmission cylinder having a lug longitudinally formed on said second retainer and inserted between two said spring ends of said second restoring spring for ensuring a specific orientation of said first sleeve.

* * * * *